United States Patent [19]

Starner et al.

[11] 4,252,186

[45] Feb. 24, 1981

[54] CONDENSER WITH IMPROVED HEAT TRANSFER

[75] Inventors: Keith E. Starner; Harold B. Ginder; Thomas M. Rudy, all of York, Pa.

[73] Assignee: Borg-Warner Corporation, Chicago, Ill.

[21] Appl. No.: 76,714

[22] Filed: Sep. 19, 1979

[51] Int. Cl.[3] ..... F28B 1/02; F28F 9/22

[52] U.S. Cl. ..... 165/114; 165/161

[58] Field of Search ..... 165/161, 160, 114, 134; 122/483

[56] References Cited

U.S. PATENT DOCUMENTS

| | | | |
|---|---|---|---|
| 1,917,595 | 7/1933 | McDermet | 165/161 |
| 2,916,264 | 12/1959 | Rhodes | 165/161 |
| 2,919,903 | 1/1960 | Vautrain et al. | 165/161 |
| 3,020,024 | 2/1962 | Lawrance | 165/161 |
| 3,048,373 | 8/1962 | Bauer et al. | 165/161 |
| 3,749,160 | 7/1973 | Vestre | 165/160 |

*Primary Examiner*—Sheldon J. Richter

*Attorney, Agent, or Firm*—Thomas B. Hunter

[57] ABSTRACT

An improved condenser including a longitudinal extending baffle and a series of transversely extending baffle plates creating a desired flow path for vapor to be cooled which is introduced into a shell. The condenser is characterized by high efficiency performance resulting from improved heat transfer coefficients and better purging of non-condensable gases because of the novel baffle arrangement.

3 Claims, 4 Drawing Figures

CONDENSER WITH IMPROVED HEAT TRANSFER

BACKGROUND OF THE INVENTION

1. Field of the Invention:

Tube and shell heat exchangers having longitudinal and transverse baffles associated with the tube bundle and generally classified in Class 165, Subclass 161.

2. Description of the Prior Art:

In U.S. Pat. No. 2,916,264 (H. F. Rhodes) there is described a heat exchanger of the tube and shell type in which a baffle plate 18 is located adjacent the inlet 22 to redirect the flow of vapor from a point intermediate the shell to a point near the end of the tube bundle. The medium entering the heat exchanger, is well defined into two portions and directed to opposite ends of the shell.

In U.S. Pat. No. 2,919,903 (L. H. Vautrain et al) a similar manifold is provided adjacent the inlet but it is constructed essentially the same way as the previously described Rhodes heat exchanger.

In the TEMA 2-1 J shell, depicted in FIG. 1*a* of the drawings, external piping provides an inlet for vapor at opposite ends of the shell. Obviously, this increases the overall size of the unit and creates additional problems in fabrication.

SUMMARY OF THE INVENTION

In the typical shell and tube condenser, vapor is introduced into a shell and is caused to flow in heat exchange relation with a tube bundle through which a coolant, such as water, is circulated. The vapor, coming into contact with the tubes is cooled and condensed. The condensate is collected in the lower portion of the shell and removed through an appropriate outlet line.

The tube bundle itself may take a variety of forms; but in many designs it is a straight, single pass system with an inlet header at one end of the shell and outlet header at the other end. In practice, a series of baffles are usually provided which force the vapor to pass back and forth over the tube bundle to increase the vapor velocity and thus resulting in a higher overall coefficient of heat transfer.

It is well known that the pressure drop along the path of vapor flow is increased as the number of times that the vapor is caused to traverse the tube bundle. However, little attention has been paid to improving the performance of the condenser due to increasing the vapor velocity without a corresponding increase in pressure drop.

In the present invention, this is accomplished by means of an improved construction whereby the vapor is introduced into the shell at a central location at or near the midpoint between the ends of the shell. A longitudinally extending baffle divides the flow and causes it to move to opposite ends where it then flows downwardly toward the tubes. It then reverses direction with each portion moving from the ends to the center of the shell. Cross baffles cause it to traverse the bundle several times; but the number of such traverses along each separate flow path is roughly half of what would occur from one end of the shell to the other.

The instant invention includes further a purge outlet connection located centrally on the side of the shell for effective removal of non-condensable fluids in the flow path set up by the baffle arrangement. This combination of baffle arrangement and purge connection renders an improved efficiency in the coefficient of heat transfer due to the higher vapor velocity flow over the tubes and better purging, but yet without increasing the pressure drop.

DETAILED DESCRIPTION OF THE PREFERRED EMBODIMENT

Figures 1, 1A, 2, 3:
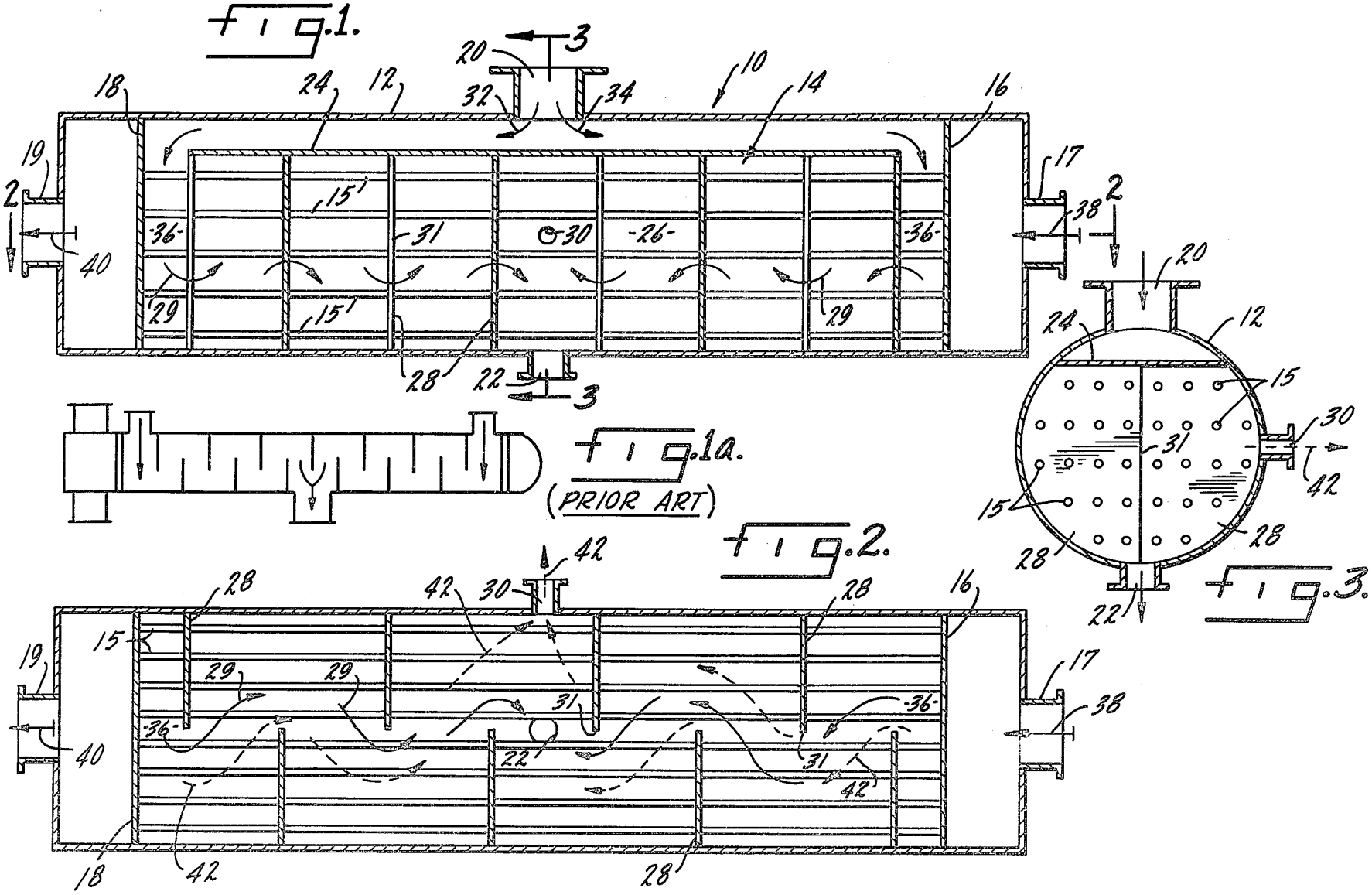
FIG. 1a. (PRIOR ART)
FIG. 1*a* is a side sectional view of the prior art device of a TEMA 2-1 J shell.
FIG. 1 is a longitudinal view in section of a condenser constructed in accordance with the principles of the present invention.
FIG. 2 is a transverse sectional view taken along the plane of line 2—2 of FIG. 1.
FIG. 3 is a cross-sectional view taken along the plane of line 3—3 of FIG. 1.

Referring now in particular to FIGS. 1 and 2 of the drawings, a condenser generally designated by reference numeral 10 comprises an elongated, fairly cylindrical shell 12 having a tube bundle 14 arranged longitudinally therein. The tube bundle 14 is formed of a series of individual tubes 15 extending parallel to the major longitudinal axis of the shell 12. At one end the tubes 15 are supported in a header plate 16 and at the opposite end by a header plate 18. An inlet header 17 is in fluid communication with the header plate 16 to provide a path for a coolant from a suitable source (not shown) to be circulated through the tubes 15 and at the opposite end an outlet header 19 is in fluid communication with the header plate 18. While the coolant is normally water, it should be clearly understood by those skilled in the art that other coolants such as ethylene glycol, etc. may be used.

The shell 12 is provided with a vapor inlet 20 at a point generally at the midpoint between the ends of the shell 12 for receiving and conducting a fluid to be cooled by passing it into contact with the tubes. At the lower portion of the shell 12 opposite the vapor inlet 20, there is provided a condensate or liquid outlet 22 for conducting away the condensate from the shell 12. Arranged within the shell at the upper portion thereof and above the tube bundle 14 is a longitudinally extending baffle 24 which extends in a substantially parallel relationship to the tubes 15 and substantially the entire length of a condensing chamber 26 defined between the two header plates 16 and 18.

Arranged within the shell 12 are a series of transversely extending baffle plates 28 which alternately extend from opposite sides of the shell to a point substantially half-way across the shell diameter to form an undulating flow path for the fluid or vapor to be cooled as it moves from the opposite ends towards the center of the shell. Each of the baffle plates 28 also assist in supporting the individual tubes 15 intermediate their ends at the respective header plates 16 and 18. The tubes 15 extend through the baffle plates 28 and are fixed to the plates in any suitable manner well-known in the art. As can be best seen in FIG. 2, the plates 28 are arranged in a staggered relationship to each other and are joined at their top ends to the longitudinal baffle 24 so as to define the undulating or sinuous flow path around the tubes 15 for the fluid to be cooled as indicated by the solid arcuate arrows 29.

As the side of the shell 12 is a small, centrally located purge port or outlet 30 (FIGS. 2 and 3) to which a purging device may be connected to draw off air and other various non-condensable fluids which may collect during the operation of the condenser. It will be understood that in the operation of a refrigerant system some air may be drawn into the system from time to time and this air, being non-condensable, reduces the operating efficiency of the unit.

In operation of the condenser 10, the fluid to be cooled, as for example, heated refrigerant in vapor form from a compressor, enters the shell 12 by way of the vapor inlet 20 and is divided approximately into two equal flow portions. Since the longitudinal baffle 24 is arranged to extend in a parallel relationship to one side of the shell and substantially normal to the axis of the vapor flow entering through the inlet 20, this construction causes the vapor to travel initially in two directions as shown by the arrows 32 and 34 parallel to the tubes 15 to spaces 36 provided adjacent the header plates 16 and 18 at the opposite ends of the shell. From the spaces 36, each portion of the vapor path then moves toward the center of the shell 12 working back and forth against the tube bundle 14 by virtue of the transverse baffle plates 28 extending from the opposite sides of the shell, the direction of the vapor flow being reversed adjacent each of the open ends 31 of the plates.

In passing between the tubes 15, the vapor becomes in indirect heat exchange relationship with the coolant flowing through the tubes which will condense the vapor. This cooled liquid will collect at the lower portion of the shell and gravitate toward the condensate outlet 22. The coolant is delivered in the direction of the arrow 38 to the plurality of tubes 15 via the header plate 16 and the inlet header 17. In flowing through the tubes, the coolant absorbs heat from the vapor to be cooled and thereafter, the heated coolant is discharged in the direction of arrow 40 from the tubes by means of the header plate 19 and the outlet header 19. At the same time, the shell is purged from time to time through the purge connection or outlet 30 to permit the escape of the non-condensable fluids flowing within the shell as indicated by broken arrows 42.

The directed flow path of the refrigerant vapor due to the arrangement of the baffles 24, 28 causes the non-condensable fluids or gases to be dragged to the region of the purge connection 30. The purging action substantially removes the non-condensable gases from a major portion of the tube bundle 14, thereby eliminating the resistance to heat transfer. Such heat transfer resistance is prevalent with non-baffled condensers resulting from a blanketing effect caused by the gases which prevent the influx of condensable vapor molecules to the surfaces of the tubes.

By virtue of the improved condenser construction, the number of times that the vapor is constrained to move across the tube bundle 14 is substantially reduced, as compared to a condenser construction such as shown and described in the above-mentioned U.S. Pat. No. 2,916,264 to Rhodes. The instant invention greatly reduces the pressure drop and generally enhances the condensing efficiency of the unit.

While there has been illustrated and described what is at present to be a preferred embodiment of the present invention, it will be understood by those skilled in the art that various changes and modifications may be made and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out this invention but the invention will include all embodiments falling within the scope of the appended claims.

What is claimed is:

1. In a condenser of the shell and tube bundle type which includes an elongated shell, a tube bundle consisting of a plurality of spaced parallel tubes disposed longitudinally within said shell, an inlet header communicating with one end of said tubes and an outlet header communicating with the other end of said tubes, the improvement comprising:

vapor inlet means disposed substantially at the midpoint between the ends of said shell for circulating a fluid to be cooled into contact with said tubes;

liquid outlet means disposed opposite of said inlet means for withdrawing of condensate from said shell;

longitudinal baffle means disposed within said shell for distributing said fluid in said inlet means to the opposite ends of said shell, said longitudinal baffle means including a longitudinal extending baffle which extends substantially the entire length of a chamber defined between said inlet header and said outlet header; and transverse baffle means disposed within said shell for directing the flow of said fluid at the opposite ends of said shell toward the center of said shell and to said outlet means, said transverse baffle means including a plurality of transversely extending baffle plates which alternately extend from opposite sides of said shell, each of said plates extending to substantially the midpoint of said shell.

2. In a condenser as claimed in claim 1, further comprising means for purging non-condensable fluids in the flow path set up by said longitudinal and transverse baffle means from said shell.

3. In a condenser as claimed in claim 2, wherein said purging means comprises a small, centrally located port disposed on the side of said shell which is adapted for connection to a purging device for withdrawing air and other various non-condensable fluids from said shell.

* * * * *